US006048294A

United States Patent [19]

Formanek

[11] Patent Number: 6,048,294

[45] Date of Patent: Apr. 11, 2000

[54] EXERCISE APPARATUS

[76] Inventor: Thomas G. Formanek, 6754 S. 73rd Cir., Ralston, Nebr. 68127

[21] Appl. No.: 09/167,059

[22] Filed: Oct. 6, 1998

[51] Int. Cl.[7] ..... A63B 26/00

[52] U.S. Cl. ..... 482/142; 482/141; 74/551.1

[58] Field of Search ..... 482/95, 96, 148, 482/141, 38, 41; 74/551.1, 551.9; D21/686, 690, 691

[56] References Cited

U.S. PATENT DOCUMENTS

| | | | |
|---|---|---|---|
| D. 337,748 | 7/1993 | Adams | D12/178 |
| 2,133,010 | 10/1938 | Barry . | |
| 4,337,962 | 7/1982 | Allen | 280/279 |
| 4,620,701 | 11/1986 | Mojden | 482/41 |
| 4,638,995 | 1/1987 | Wilson | 482/38 X |
| 4,666,154 | 5/1987 | Lipscomb . | |
| 4,750,754 | 6/1988 | Lennon | 74/551.1 X |
| 4,850,589 | 7/1989 | Block . | |
| 5,197,350 | 3/1993 | Borromeo | 74/551.1 |
| 5,224,396 | 7/1993 | Lobbezoo | 74/551.1 |
| 5,285,696 | 2/1994 | Taylor | 74/551.1 |
| 5,407,404 | 4/1995 | Killian | 482/38 |
| 5,423,728 | 6/1995 | Goldberg | 482/57 |
| 5,569,141 | 10/1996 | Chou | 482/144 |
| 5,749,818 | 5/1998 | Sather | 482/141 |
| 5,752,903 | 5/1998 | Chang | 482/141 |
| 5,910,074 | 6/1999 | Purdie | 482/141 |

FOREIGN PATENT DOCUMENTS

WO 84/02660 7/1984 WIPO .

*Primary Examiner*—Richard J. Apley
*Assistant Examiner*—Lori Baker
*Attorney, Agent, or Firm*—Koley, Jessen, Daubman & Rupiper, P.C.; Mark D. Frederiksen

[57] ABSTRACT

The exercise apparatus of the present invention includes an elongated generally C-shaped bar with an elongated back portion and a pair of opposing curved end portions, the bar supported on a support frame in a generally horizontal plane. Each end portion includes a straight section extending outwardly from the back portion, a curved section extending forwardly and then inwardly from each straight section and an end section terminating in a free end substantially parallel to the back portion and extending inwardly from the forward ends of the curved sections. Each of the end portions is a length sufficient to permit gripping by at least one hand of a consumer, and the back portion has a length sufficient for gripping by two hands of the consumer, to enable the consumer to do pushups with a variety of different hand positions. The bar may either be free standing, on its own support stand, or connected to a pre-existing exercise framework.

17 Claims, 3 Drawing Sheets

EXERCISE APPARATUS

TECHNICAL FIELD

The present invention relates generally to exercise equipment and more particularly to a device for enabling a variety of positions for performing pushups and related exercises.

BACKGROUND OF THE INVENTION

A wide variety of exercise equipment are currently available to stretch and flex various muscle groups. More recently, exercise equipment has been specially manufactured to develop very specific muscle groups in the human body.

While most versatile exercise equipment includes a portion for enabling the user to do pushups, this prior art equipment does not offer a variety of gripping positions to enhance development of pectoral, frontal and medial deltoid, and triceps muscles.

SUMMARY OF THE INVENTION

It is therefore a general object of the present invention to provide an improved exercise apparatus to enhance the development of specific muscle groups.

Another object is to provide an improved exercise apparatus which enables the user to utilize a plurality of different exercising positions.

Yet another object of the present invention is to provide an improved exercise apparatus which may be free standing, or easily attached to existing exercise equipment.

Yet a further object is to provide an improved exercise apparatus which is economical to manufacture and simple to use.

These and other objects of the present invention will be apparent to those skilled in the art.

The exercise apparatus of the present invention includes an elongated generally C-shaped bar with an elongated back portion and a pair of opposing curved end portions, the bar supported on a support frame in a generally horizontal plane. Each end portion includes a straight section extending outwardly from the back portion, a curved section extending forwardly and thence inwardly from each straight section and an end section terminating in a free end substantially parallel to the back portion and extending inwardly from the forward ends of the curved sections. Each of the end portions is a length sufficient to permit gripping by at least one hand of a consumer, and the back portion has a length sufficient for gripping by two hands of the consumer, to enable the consumer to do pushups with a variety of different hand positions. The bar may either be free standing, on its own support stand, or connected to a pre-existing exercise framework.

DESCRIPTION OF THE PREFERRED EMBODIMENT

Figure 1:
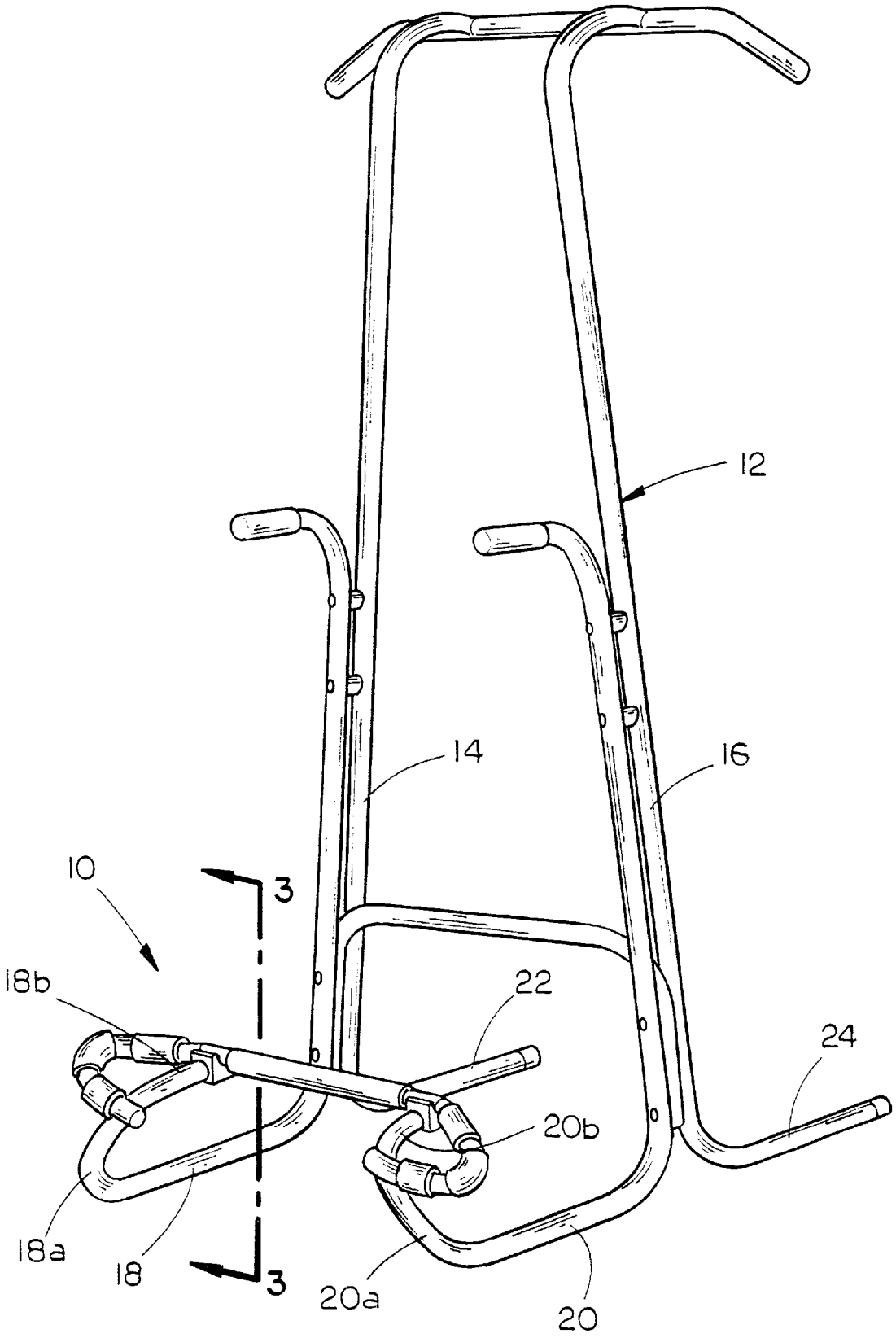
FIG. 1 is a perspective view of the exercise apparatus of the present invention, installed on an existing exercise framework.

Referring now to the drawings, in which similar or corresponding parts are identified with the same reference numeral, and more particularly to FIG. 1, the exercise apparatus of the present invention is designated generally at 10 and is shown connected to a framework 12 of a configuration utilized for a variety of different exercises.

Framework 12 may be of any conventional variety, but preferably includes a pair of vertically extending posts 14 and 16, supported in a vertical orientation by a pair of forwardly extending legs 18 and 20, and a pair of rearwardly extending legs 22 and 24. Each of forward legs 18 and 20 have a curved forward portion 18*a* and 20*a* which curve upwardly, and thence rearwardly to a free end 18*b* and 20*b* respectively, such that the free ends 18*b* and 20*b* are generally parallel to legs 18 and 20 rearward of forward portions 18*a* and 20*a*. Free ends 18*b* and 20*b* are also preferably located parallel to one another and spaced apart a distance of 18–20 inches. This places ends 18*b* and 20*b* at approximately shoulder width, so that a person can grasp ends 18*b* and 20*b* to do pushups.

Figure 2:
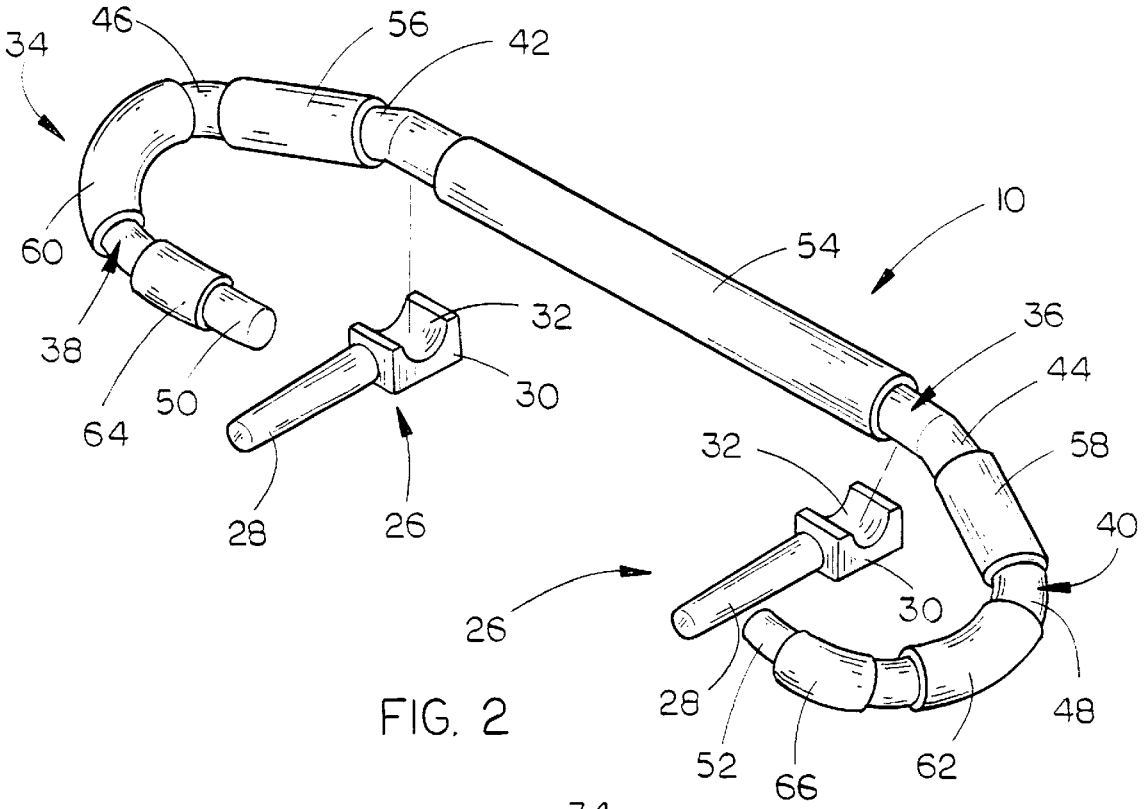
FIG. 2 is an enlarged perspective view of the exercise apparatus with a pair of connecting support members shown exploded away from the apparatus.
Figure 3:
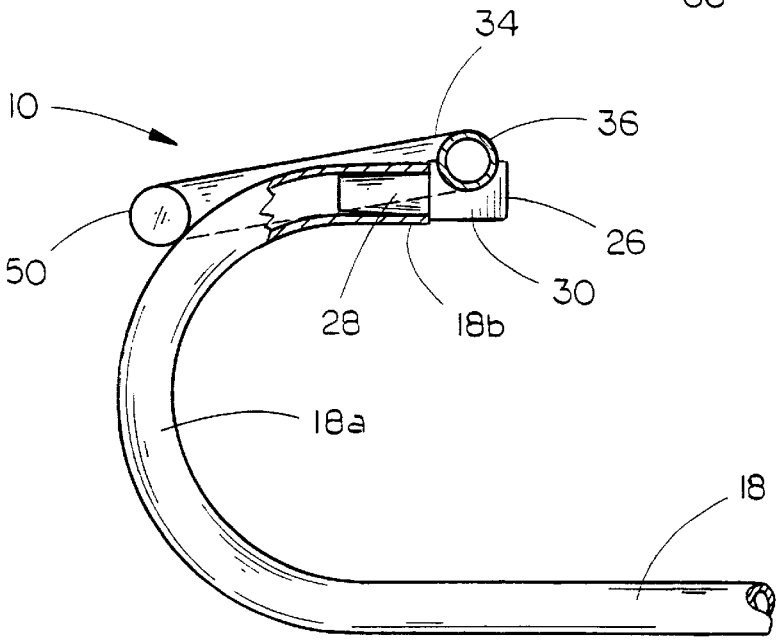
FIG. 3 is a partial enlarged sectional view of the exercise apparatus, taken at lines 3—3 in FIG. 1.
Figure 4:
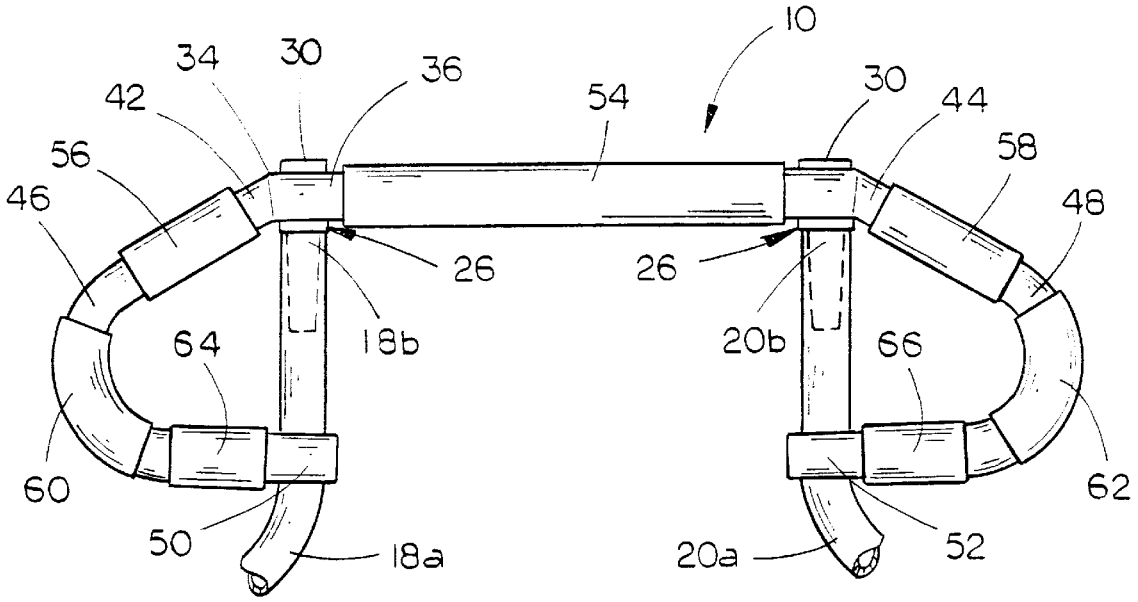
FIG. 4 is a top plan view of the exercise apparatus installed on the framework of FIG. 1.

Referring now to FIGS. 2–4, exercise apparatus 10 is shown supported on a pair of support members 26 journaled within the free ends 18*b* and 20*b* of legs 18 and 20 respectively. Each support member 26 includes a tapered rod 28 with a support block 30 affixed to the large diameter end of rod 28. Rod 28 is journaled within the free ends 18*b* or 20*b* of legs 18 and 20, and is secured by a tight friction fit therein. Each block 30 has a semi-cylindrical groove 32 formed in the upper surface thereof, to receive the exercise apparatus 10, as described in more detail hereinbelow.

Exercise apparatus 10 includes a generally C-shaped tubular bar 34 having an elongated straight back portion 36 and opposing end portions 38 and 40. Each end portion 38 and 40 includes a short straight section 42 and 44, respectively, angled slightly forwardly, a curved section 46 and 48 extending from the distal ends of straight sections 42 and 44, respectively, and straight end sections 50 and 52 which are coaxial, and extend from the free ends of curved sections 46 and 48, respectively.

Back portion 36 is preferably covered with a cylindrical cushion 54 of a resilient sponge-like material which permits comfortable gripping with the hands. Cushion 54 has a length sufficient to permit both hands of the user to grip the cushion, for doing pushups. Preferably, cushion 54 extends a length less than the length of back portion 36, to reveal the ends of back portion 36 for support directly on blocks 30 of support members 26.

Straight sections 42 and 44 also have short cylindrical cushions 56 and 58, respectively, each being of a length to permit a single hand to grip the respective cushions 56 and 58. Curved sections 46 and 48 each have curved cylindrical cushions 60 and 62 thereon, each having a length permitting a user to grip each cushion 60 and 62 with one hand. Finally, end sections 50 and 52 have cylindrical cushions 64 and 66, each being a length to permit a single hand to grip the respective cushions.

In use, exercise apparatus 10 is supported on framework 12 by resting the exposed ends of back portion 36 in the grooves 32 of support members 26, with the distal ends of end sections 50 and 52 contacting the curved portions 18*a* and 20*a* of legs 18 and 20, such that bar 34 rests within a substantially horizontal plane. Four separate positions are thereby provided for a user to do pushups, which flex and stretch different portions of different muscle groups to thereby develop and enhance the muscle groups. More specifically, repeating pushups with the hands located adjacent the opposing ends of cushion 54 will exercise the upper pectorals, medial deltoids, and the outer triceps muscles. Repeating pushups with the hands located on cushions 56 and 58 will exercise the pectorals, anterior deltoids, and posterior triceps muscles. Repeating pushups with the hands located on cushions 60 and 62 will concentrate stretching and flexing of the pectoral muscles. Finally, repeating pushups with the hands located on cushions 64 and 66 will exercise the anterior deltoids, triceps and center pectorals. Thus, development of the pectoral, deltoid and triceps muscle groups are enhanced by enabling the user to position the hands along different portions of exercise apparatus 10.

Figure 5:
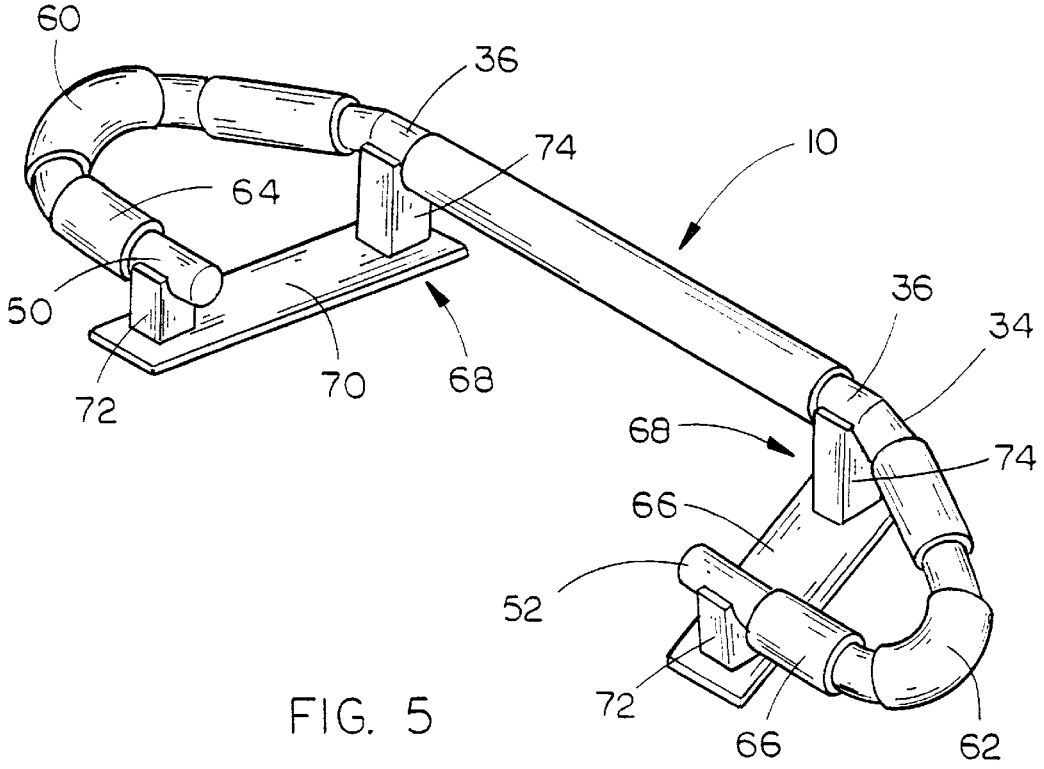
FIG. 5 is an enlarged perspective view of the exercise apparatus installed on an independent support frame.

Referring now to FIG. 5, the exercise apparatus 10 is shown supported on a pair of free standing frames 68. Each frame 68 includes an elongated base plate 70 with an upstanding block 72 and 74 mounted on the forward and rearward ends thereof. Each block 72 and 74 has a semi-cylindrical groove 76 formed in the upper end thereof, to receive portions of the tubular bar 34 of exercise apparatus 10 therein. As shown in FIG. 5, one frame 68 is located with block 74 receiving one end of back portion 36 and block 72 receiving end section 50 therein. The second frame 68 is positioned with block 74 receiving the opposite end of back portion 36 and block 72 receiving end section 52 therein. As with framework 12, frames 68 are provided with blocks 72 and 74 of a height to maintain exercise apparatus 10 in a generally horizontal plane.

Whereas the invention has been shown and described in connection with the preferred embodiments thereof, many modifications, substitutions and additions may be made which are within the intended broad scope of the appended claims.

I claim:

1. An exercise apparatus comprising:

an elongated, generally C-shaped bar having a diameter permitting gripping by human hands, and having an elongated back portion with opposing first and second end portions;

said back and end portions supported in a generally horizontal plane spaced above ground, on a support frame;

said back portion having a length permitting gripping by two hands;

each end portion of a length permitting gripping by at least one hand;

said end portions each including an end section terminating in a free end substantially parallel to the back portion;

said support frame including portions in direct supporting contact with the back portion and each end section;

said support frame further including:

a first pair of blocks, one block extending between the first end section and the ground, and one block extending between a first end of the back portion and the ground; and a second pair of blocks, one block extending between the second end section and the ground, and one block extending between a second end of the back, portion and the ground.

2. The exercise apparatus of claim 1, wherein said bar further includes:

a first curved section between the back portion and first end portion end section, having a length permitting gripping by a hand; and a second curved section between the back portion and second end portion end section, having a length permitting gripping by a hand.

3. The exercise apparatus of claim 2, wherein said bar further includes:

a first straight section between the first curved section and the back portion, having a length permitting gripping by a hand; and a second straight section between the second curved section and the back portion, having a length permitting gripping by a hand.

4. The exercise apparatus of claim 3, wherein said back portion is straight.

5. The exercise apparatus of claim 4, wherein said bar is cylindrical.

6. The exercise apparatus of claim 5, further comprising a cylindrical cushion of resilient compressible material extending around the diameter of the back portion and substantially along the length thereof.

7. The exercise apparatus of claim 6, wherein said back portion cushion extends a length short of the opposing ends of the back portion, to form revealed ends on the back portion, and wherein said support frame includes portions in direct contact with each of said revealed ends.

8. The exercise apparatus of claim 7, further comprising a plurality of cylindrical cushions of resilient, compressible material, each extending around the diameter and along a portion of the length of each of said first and second curved sections and each of said first and second straight sections.

9. The exercise apparatus of claim 8, wherein said support frame includes:

a framework permitting a user to perform exercises thereon;

said framework including a pair of forwardly extending, spaced apart, and generally parallel legs, said legs each having a curved forward portion curving upwardly and thence rearwardly to a free end, the free ends extending generally horizontally; and a pair of support members connected to the free ends of the legs, each support member having a groove for receiving and supporting a portion of the back portion;

said bar positioned with opposing ends of the back portion in the support member grooves and with a portion of each end portion in direct contact with a portion of each leg curved forward portion.

10. The exercise apparatus of claim 1, wherein said bar further includes:

a first straight section between the first curved section and the back portion, having a length permitting gripping by a hand; and a second straight section between the second curved section and the back portion, having a length permitting gripping by a hand.

11. The exercise apparatus of claim 1, wherein said back portion is straight.

12. The exercise apparatus of claim 1, wherein said bar is cylindrical.

13. The exercise apparatus of claim 1, further comprising a cylindrical cushion of resilient compressible material extending around the diameter of the back portion and substantially along the length thereof.

14. The exercise apparatus of claim 13, wherein said back portion cushion extends a length short of the opposing ends of the back portion, to form revealed ends on the back portion, and wherein said support frame includes portions in direct contact with each of said revealed ends.

15. The exercise apparatus of claim 10, further comprising a plurality of cylindrical cushions of resilient, compressible material, each extending around the diameter and along a portion of the length of each of said first and second curved sections and each of said first and second straight sections.

16. The exercise apparatus of claim 1, wherein said support frame includes:

a framework permitting a user to perform exercises thereon;

said framework including a pair of forwardly extending, spaced apart, and generally parallel legs, said legs each having a curved forward portion curving upwardly and thence rearwardly to a free end, the free ends extending generally horizontally; and a pair of support members connected to the free ends of the legs, each support member having a groove for receiving and supporting a portion of the back portion;

said bar positioned with opposing ends of the back portion in the support member grooves and with a portion of each end portion in direct contact with a portion of each curved forward portion.

17. The exercise apparatus of claim 1, wherein said support frame includes:

a first support extending between a first end of the back portion, the first end section, and the ground, for supporting both the first end section and back portion first end above the ground; and a second support extending between a second end of the back portion, the second end section, and the ground, for supporting both the second end section and back portion second end above the ground.

* * * * *